US008876484B2

(12) United States Patent
Duong et al.

(10) Patent No.: US 8,876,484 B2
(45) Date of Patent: Nov. 4, 2014

(54) TURBINE BLADE POCKET PIN STRESS RELIEF

(75) Inventors: Loc Quang Duong, San Diego, CA (US); Xiaolan Hu, San Diego, CA (US); Anthony C. Jones, San Diego, CA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 507 days.

(21) Appl. No.: 13/198,808

(22) Filed: Aug. 5, 2011

(65) Prior Publication Data

US 2013/0034446 A1 Feb. 7, 2013

(51) Int. Cl.

| | |
|---|---|
| ***F04D 29/32*** | (2006.01) |
| ***F01D 5/18*** | (2006.01) |
| ***F01D 5/14*** | (2006.01) |

(52) U.S. Cl.

CPC ..... *F01D 5/147* (2013.01); *F05D 2260/941* (2013.01); *F01D 5/18* (2013.01)

USPC ..... 416/231 B; 416/233

(58) Field of Classification Search

CPC ..... F01D 5/147; F01D 5/18; F01D 5/16; F01D 5/181; F01D 5/143; F01D 5/187; F05D 2260/941; F05B 2240/801

USPC ..... 416/232, 233, 231 R, 231 B; 415/115

See application file for complete search history.

(56) References Cited

U.S. PATENT DOCUMENTS

| | | | | |
|---|---|---|---|---|
| 3,314,651 | A | 4/1967 | Beale | |
| 4,108,573 | A * | 8/1978 | Wagner | 416/236 A |
| 4,161,318 | A | 7/1979 | Stuart et al. | |
| 5,112,194 | A | 5/1992 | More | |
| 5,188,507 | A | 2/1993 | Sweeney | |
| 5,205,706 | A | 4/1993 | Belcher | |
| 5,639,210 | A | 6/1997 | Carpenter et al. | |
| 6,068,443 | A | 5/2000 | Aoki et al. | |
| 6,478,537 | B2 * | 11/2002 | Junkin | 415/173.1 |
| 6,575,693 | B2 * | 6/2003 | Pross et al. | 415/1 |
| 6,932,571 | B2 | 8/2005 | Cunha et al. | |
| 7,413,403 | B2 | 8/2008 | Cunha et al. | |
| 8,075,275 | B2 * | 12/2011 | Althoff et al. | 416/226 |
| 2011/0293436 | A1 * | 12/2011 | Di Florio et al. | 416/233 |

* cited by examiner

*Primary Examiner* — Edward Look
*Assistant Examiner* — Christopher J Hargitt
(74) *Attorney, Agent, or Firm* — Carlson, Gaskey & Olds, PC

(57) ABSTRACT

A turbine blade comprises an airfoil having a pressure side and a suction side, and extending from a leading edge to a trailing edge. The airfoil has a tip remote from a mounting root, and a pocket extending inwardly of the tip. The pocket has spaced walls with one wall associated with the pressure side of the airfoil, and an opposed wall associated with the suction side. A pin extends across the pocket and connects the opposed walls. A slot is formed in the pin at a location intermediate ends of the pin which connect to the opposed walls. A method for identifying a location for the pin along a distance between a leading edge and a trailing edge of the pocket utilizes a modal analysis, and seeks to find a location where both a reaction force and a moment are lower than they might be at other locations.

16 Claims, 3 Drawing Sheets

TURBINE BLADE POCKET PIN STRESS RELIEF

BACKGROUND

This application relates to a way of relieving stress that will be imposed on a pin connecting the opposed walls in a pocket at a radially outer end of a turbine blade.

Gas turbine engines are known, and typically include a compressor compressing air and delivering it into a combustion chamber. The air is mixed with fuel and combusted, and then passes downstream over turbine rotors. The turbine rotors typically include a plurality of removable blades.

The turbine blades are subjected to high temperatures, and any number of stresses and challenges. Thus, a good deal of design is incorporated into the turbine blades.

Generally a turbine blade includes an airfoil extending outwardly of a platform, and a root which allows the blade to be mounted in a rotor. In one known turbine blade, a cavity or pocket is formed extending inwardly from the radially outer tip for a particular depth.

The pocket is defined by a pair of spaced walls. It has been found that for structural reasons, it is desirable to have a pin connecting the two spaced walls at a point along the distance of the pocket. Thus, one or more pins may connect a pressure wall of the blade to a suction wall. The pressure and suction walls are exposed to distinct temperatures during operation, and thus there are stresses imposed along the length of the pin. The peak stress is generally applied at a point where the pin connects to the walls.

Among the stresses are low cycle fatigue and high cycle fatigue loadings. These are reacted at the locations where the blade ends connect to the walls. The primary low cycle fatigue loading occurs from distinct temperatures on the two sides of the blade. Usually, the suction wall is hotter than the pressure wall. Further, there are high cycle fatigue loadings. As an example, there are typically hot streaks in a combustor pattern. Thus, the pin is subject to a cyclic loading of a frequency equal to the number of hot streaks, multiplied by the number of shaft revolutions per second. In addition, another high cycle fatigue loading is so-called "transient interference." This can occur from non-uniform pressure distributions caused by gas flow around obstacles such as guide vanes.

SUMMARY

A turbine blade includes an airfoil having a pressure side and a suction side, and extending from a leading edge to a trailing edge. The airfoil has a tip remote from a mounting root, and a pocket extending inwardly of the tip. The pocket has spaced walls with one wall associated with the pressure side of the airfoil, and an opposed wall associated with the suction side. A pin extends across the pocket and connects the opposed walls. A slot is formed in the pin at a location intermediate ends of the pin which connect to the opposed walls.

A method is also described for identifying a location for the pin along a distance between a leading edge and a trailing edge of the pocket. The method utilizes a modal analysis, and seeks to find a location where both a reaction force and a moment are lower than they might be at other locations.

These and other features of the present invention can be best understood from the following specification and drawings, of which the following is a brief description.

DETAILED DESCRIPTION

Figure 1:
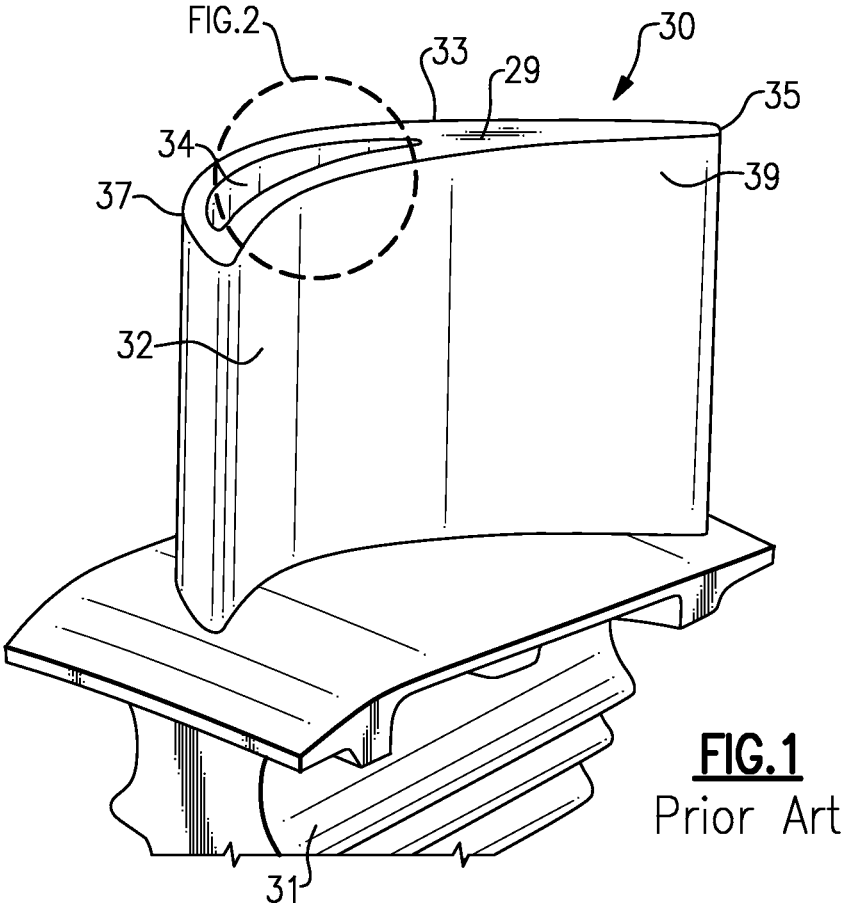
FIG.1 Prior Art
FIG. 1 shows a known turbine blade.

A turbine blade 30 is illustrated in FIG. 1, and has an airfoil 32 extending upwardly of root 31. A radially outer tip 29 includes a cavity or pocket 34 extending into a portion of the length of the airfoil 32. A suction wall 33 and a pressure wall 39 are further defined. A leading edge 37 and a trailing edge 35 are also shown. As can be appreciated from FIG. 1, the pocket 34 extends in a direction from the leading edge 37 toward the trailing edge 35.

Figure 2:
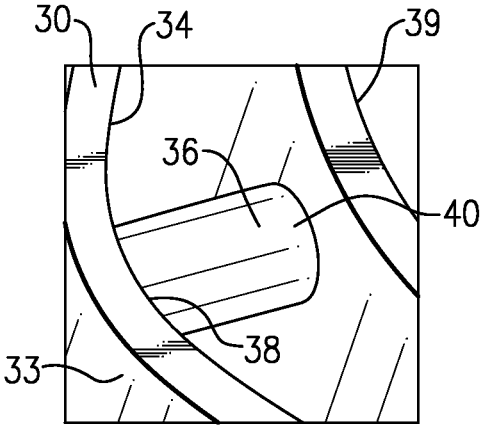
FIG.2 Prior Art
FIG. 2 shows a portion of the turbine blade along the area identified by the circled 2 in FIG. 1.

As shown in FIG. 2, a pin 36 is provided in the pocket 34, and between the pressure and suction walls 39 and 33. As mentioned above, there are stresses imposed along the length of the pin 36 due to uneven temperature, and any number of other challenges. As shown, the pin 36 extends between an end 38 associated with the suction wall 33, and an end 40 associated with the pressure wall 39.

Figure 3A:
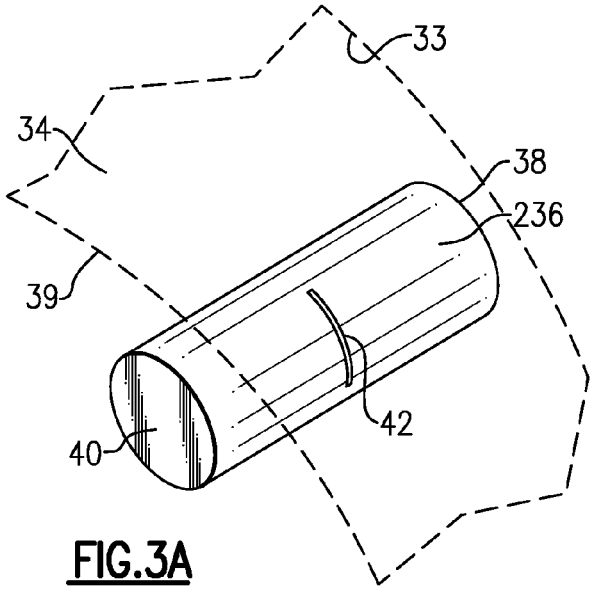
FIG. 3A shows an improvement to a pin.

FIG. 3A shows an improved pin 236 extending between walls 33 and 39, and having ends 38 and 40. A slot 42 is formed at a location along a length of the pin 236. As shown, the pin 236 is generally cylindrical, although the pin is not limited to cylindrical shapes. The slot 42 essentially decouples the two ends 38 and 40, such that the stresses imposed at each end do not affect the other end. Generally, the unequal temperatures faced by the two ends 38 and 40 can cause the entire pin to twist and move, and the slot 42 decouples the transfer of the stresses.

Figure 3B:
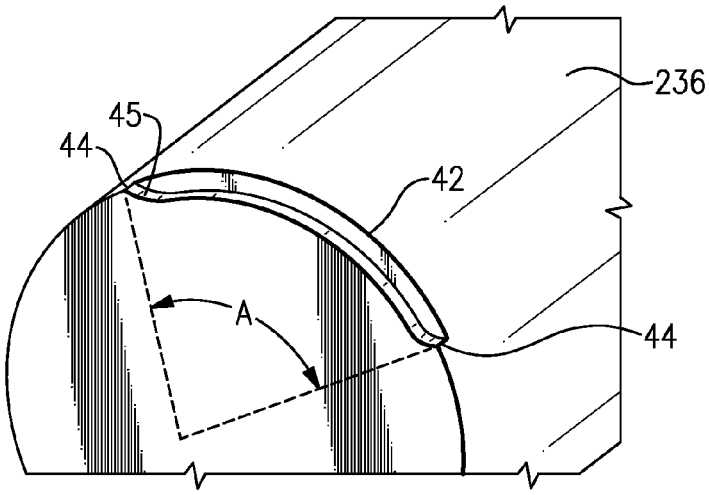
FIG. 3B shows further detail of this improvement.

FIG. 3B shows the slot 42 extending between circumferential edges 44. As can be appreciated, there is a ramp 45 ramping outwardly from the slot 42 to the ends 44. Further, as can be appreciated, the slot 42 extends across an angle A defined around a center line of the pin 236.

Figure 3C:
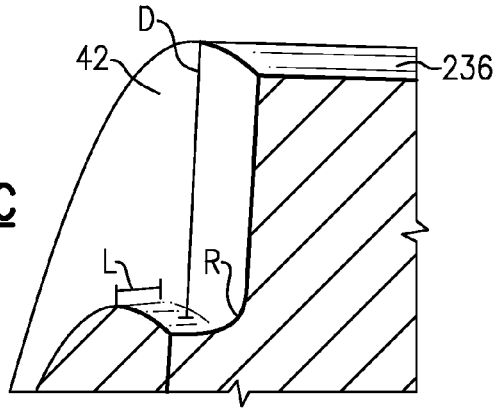
FIG. 3C is yet another view of the improvement.

As shown in FIG. 3C, the slot 42 extends inwardly for a depth D, a distance or width L, and is at a radius R where the end of the depth merges into the width L. There is a similar radius at the opposed side of the slot 42, or just to the left of the width L.

In embodiments, it is desirable that the depth D be greater than or equal to the radius R, and that the width L be less than or equal to the radius R. In one example, the depth D was greater than 1.5× the radius R, and the width W was less than 0.66 R. In one embodiment, the depth D was equal to 2 R and the width W was equal to 0.5 R.

Figure 4:
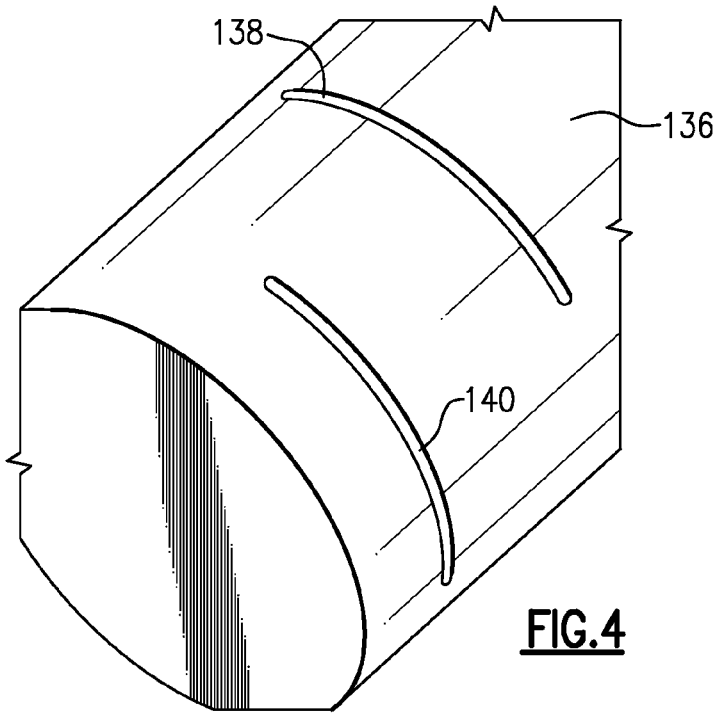
FIG. 4 shows another embodiment.

FIG. 4 shows another pin embodiment 136 having two slots 138 and 140. As can be appreciated, the slots are at different angular orientations, and different axial positions. When there are multiple loads or relative movements with distinct vector directions and different orientations, then this multi-slot embodiment can be used.

The angle, both as to circumferential location and extent, is generally selected to be in a direction and extent along which there is relative movement between the two ends 38 and 40 of the pin. In certain airfoil designs, there may be more than one direction of relative movement and thus the FIG. 4 for dual slot, or even additional slots, become useful.

The axial location along the length of the pin may be generally selected at a near central location on the pin. However, any location between the ends may be useful.

Figure 5:
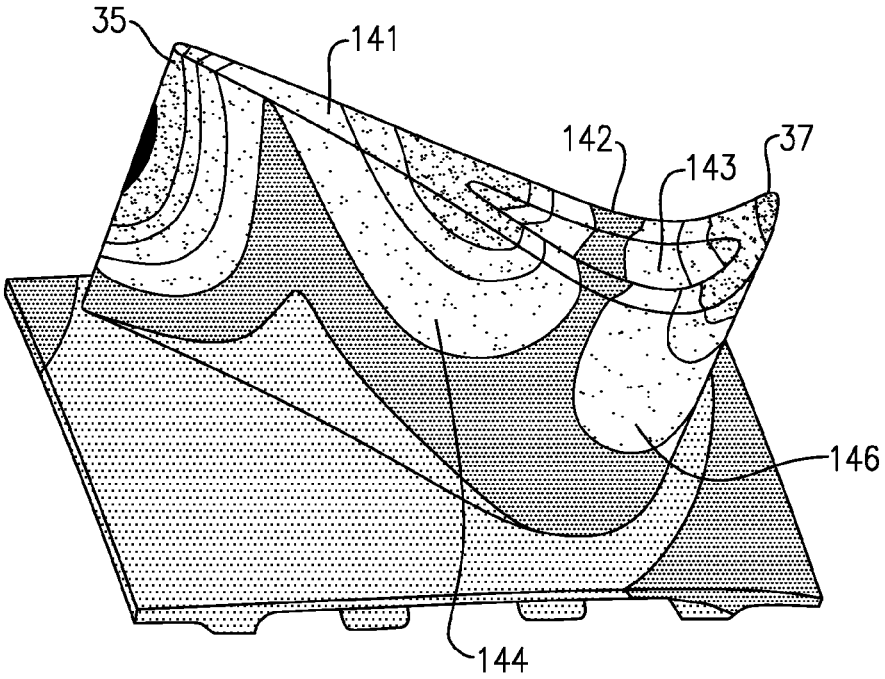
FIG. 5 shows another feature.

In another feature, the position of a pin along the length of a pocket may be selected as shown in FIG. 5. FIG. 5 shows the development of a blade 141, having a pocket 143. Typical mode shapes are shown such as at 142, 144 and 146. The state of stress in the pin at the blade walls can be defined as a reaction force and a moment, expressed as:

$$F=F_e+iF_i \quad 1)$$

and;

$$M=M_e+iM_i \quad 2)$$

$F_e$ and $M_e$ represent blade wall fixed-end steady state reaction force and moment magnitudes while $F_i$ and $M_i$ are the cyclic reaction force and moment components, respectively. The i is the imaginary unit, by definition $i^2=-1$. The imaginary part represents the cyclic loading component. Generally, the location of the pin along the distance of the pocket from the leading edge 37 toward the trailing edge 35 is selected to minimize equations 1 and 2. Computer analysis of a part using modal analysis may be utilized to find a desirable location for the pin along that distance.

As shown in FIG. 5, a point of minimal movement is identified by the mode 142. This location of minimal movement is generally also the location where the equations 1 and 2 are minimized, and thus would be the design location for the pin. For purposes of the claims in this Application, rather than actually minimizing the two equations, some location where the two equations are smaller than they would be at some other locations may be utilized.

In sum, a turbine blade having a pin that is subjected to fewer stresses and forces, and which is also better equipped to survive such stresses and forces has been disclosed. A worker of ordinary skill in this art would recognize that certain modifications would come within the scope of this invention. For that reason, the following claims should be studied to determine the true scope and content of this invention.

What is claimed is:

1. A turbine blade comprising:

an airfoil having a pressure side and suction side, and extending from a leading edge to a trailing edge, said airfoil having a tip remote from a root, and a pocket formed extending inwardly of said tip, said pocket including spaced walls with one wall associated with the pressure side, and an opposed wall associated with the suction side;

a pin extending across the pocket and connecting the opposed walls, a slot formed in the pin at a location intermediate ends of the pin which connect to the opposed walls; and said slot is formed over a limited circumferential portion of the pin.

2. The turbine blade as set forth in claim 1, wherein an angle of the slot is selected based upon a direction of relative movement between the ends.

3. The turbine blade as set forth in claim 1, wherein circumferential ends of the slot ramp upwardly from a depth of the slot to circumferential edges of the slot.

4. The turbine blade as set forth in claim 1, wherein the slot extends inwardly for a depth D, and for a width L, and a radius R connects a nominal side face of the slot to a bottom of the slot, with said bottom defining the width.

5. The turbine blade as set forth in claim 4, wherein D is greater than or equal to R.

6. The turbine blade as set forth in claim 4, wherein L is less than or equal to R.

7. The turbine blade as set forth in claim 4, wherein D is greater than 1.5 R.

8. The turbine engine blade as set forth in claim 4, wherein L is less than 0.66 R.

9. The turbine blade as set forth in claim 1, wherein there are a plurality of slots at different axial locations along the pin.

10. The turbine blade as set forth in claim 9, wherein said plurality of slots are formed at different circumferential locations around said pin.

11. The turbine blade as set forth in claim 1, wherein a location for the pin along a direction from the leading edge toward the trailing edge is determined based upon modal analysis.

12. A method of designing a turbine blade comprising the steps of:

defining an airfoil, and a pocket extending into a tip of the airfoil, the pocket configured to be formed between spaced suction and pressure walls, and the pocket configured to extend from a location adjacent the leading edge of the airfoil toward a trailing edge of the airfoil;

identifying a location for a pin to extend across the pocket and connect the suction wall to the pressure wall, utilizing a modal analysis which looks for a location of less displacement than may be found at other locations; and said slot is configured to be formed over a limited circumferential portion of the pin.

13. The method as set forth in claim 12 wherein a reactive force and moment equation are minimized to find the location for the pin.

14. The method as set forth in claim 12, wherein a location of minimal displacement is utilized to identify the location for the pin.

15. The method as set forth in claim 12, wherein an angle of the slot is selected based upon a direction of relative movement between the ends.

16. The method as set forth in claim 12, wherein circumferential ends of the slot ramp upwardly from a depth of the slot to circumferential edges of the slot.

* * * * *